US012371223B2

(12) United States Patent
Van Jaarsveld et al.

(10) Patent No.: US 12,371,223 B2
(45) Date of Patent: Jul. 29, 2025

(54) METHOD FOR PRODUCING AN EASY-OPEN LID FOR A CONTAINER, AND AN EASY-OPEN LID FOR A CONTAINER

(71) Applicant: TRIVIUM PACKAGING GROUP NETHERLANDS B.V., Deventer (NL)

(72) Inventors: Hein Van Jaarsveld, Eefde (NL); Gerard Tielbeke, Raalte (NL); Jeffry Woestefeld, Deventer (NL)

(73) Assignee: TRIVIUM PACKAGING GROUP NETHERLANDS B.V., Deventer (NL)

( * ) Notice: Subject to any disclaimer, the term of this patent is extended or adjusted under 35 U.S.C. 154(b) by 89 days.

(21) Appl. No.: 17/632,750

(22) PCT Filed: Sep. 9, 2020

(86) PCT No.: PCT/IB2020/058368

§ 371 (c)(1),
(2) Date: Feb. 3, 2022

(87) PCT Pub. No.: WO2021/048752

PCT Pub. Date: Mar. 18, 2021

(65) Prior Publication Data

US 2022/0274735 A1 Sep. 1, 2022

(30) Foreign Application Priority Data

Sep. 9, 2019 (EP) ..... 19196289

(51) Int. Cl.
*B65D 17/28* (2006.01)
*B21D 22/28* (2006.01)
(Continued)

(52) U.S. Cl.
CPC ..... *B65D 17/4012* (2018.01); *B21D 22/28* (2013.01); *B21D 51/383* (2013.01); *B21D 51/44* (2013.01)

(58) Field of Classification Search
CPC ..... B65D 17/4012; B21D 22/21–28; B21D 51/383; B21D 51/44; B21D 51/38
(Continued)

(56) References Cited

U.S. PATENT DOCUMENTS 3,750,606 A 8/1973 Schultz
5,174,706 A * 12/1992 Taniuchi ..... B65D 17/4011 72/348
(Continued)

FOREIGN PATENT DOCUMENTS

EP 1682420 7/2016

OTHER PUBLICATIONS

International Search Report, dated Nov. 2, 2020, from corresponding International Application No. PCT/IB2020/058368.
(Continued)

*Primary Examiner* — Adam J Eiseman
*Assistant Examiner* — Fred C Hammers
(74) *Attorney, Agent, or Firm* — GREENBERG TRAURIG LLP

(57) ABSTRACT

The invention relates to a method for producing a lid for closing a container, the lid reduces the risk of a user's injury when opening the container while being producible at relatively low costs. The method comprising the steps of providing a preform of the lid (10), wherein the preform of the lid (10) has opposing first and second sides (11, 12), wherein the first side (11) faces towards the inside of the container when the lid (10) is affixed to the container; forming a bead (20) in the preform of the lid (10), wherein the bead (20) extends out of said second side (12) in an axial direction from said first side (11) towards said second side (12), wherein the bead (20) comprises two radially spaced apart side wall portions (22, 24) and a bridge portion (26) connecting the side wall portions (22, 24); thinning the side wall
(Continued)

portions (22, 24) of the bead (20) at least partially, thereby elongating the side wall portions (22, 24); forming a score line (30) in the bridge portion (26) of the bead (20) on said second side (12); and flattening the bead (20) such that the two thinned side wall portions (22, 24) collapse, thereby providing the lid (10).

15 Claims, 3 Drawing Sheets

(51) Int. Cl.
*B21D 51/38* (2006.01)
*B21D 51/44* (2006.01)

(58) Field of Classification Search
USPC ..... 72/360, 347–349; 413/17
See application file for complete search history.

(56) References Cited

U.S. PATENT DOCUMENTS

| | | | | |
|---|---|---|---|---|
| 7,493,790 | B2 | 2/2009 | Heinicke | |
| 9,938,043 | B2 | 4/2018 | Chasteen et al. | |
| 2006/0113306 | A1* | 6/2006 | Heinicke | B21D 51/383 220/270 |
| 2014/0252011 | A1* | 9/2014 | Dunwoody | B21D 22/06 220/619 |
| 2015/0251237 | A1* | 9/2015 | Carstens | B21D 51/38 72/347 |

OTHER PUBLICATIONS

Written Opinion of the International Searching Authority, dated Nov. 2, 2020, from corresponding International Application No. PCT/IB2020/058368.

* cited by examiner

METHOD FOR PRODUCING AN EASY-OPEN LID FOR A CONTAINER, AND AN EASY-OPEN LID FOR A CONTAINER

The invention relates to a lid, especially an easy open end, for a container and to a method for producing such a lid for a container.

The invention generally relates to containers that are typically made of sheet metal, such as cans for food and/or drinks, and that have a container wall or a lid or a closure, specifically an easy open end that is designed to be opened by a pull-tab mechanism. Herein, the pull-tab mechanism typically has a pointed nose that is arranged adjacent a weakened area, particularly a score line, in the lid or closure. To open the container, the user pulls the pull-tab upwards thereby causing the pointed nose to break the score line. By further pulling the pull-tab, the portion of the lid that is delimited or encircled by the score line can be pulled out along the score line and possibly even be removed from the lid and/or the container.

These easy open ends for containers generally have the problem and disadvantage that sharp edges remain in the container wall or lid in the region of the score line after opening the container in the above described manner. These sharp edges can be a safety risk in that the user of the container can get hurt or injured thereby, e.g. by cutting the user's fingers.

To overcome this problem, it is generally known to provide, in the manufacture of the container, protective shoulders or projections that are formed by folding, particularly double-folding, of the lid or closure in the region of the score line. These protective shoulders or projections are preferably arranged underneath and/or in close proximity to the score line, so that, after opening the container along the score line, the shoulders or projections substantially lie in the same axial plane as or even project radially beyond the sharp edge of the pulled-open score line. Thereby, the shoulders or projections form a safety protection for the user of the container in that e.g. the user's finger will first touch the projection/shoulder instead of the sharp edge, or will at the most simultaneously touch the projection/shoulder and the sharp edge, thereby substantially keeping the user's finger away from the sharp edge and thus avoiding injury.

An easy open end for a container of the above described kind is for example known from U.S. Pat. No. 7,493,790 B2. In this device, a scored central bead that extends from an outer side of a closure panel is compressed, thereby forming first and second double folds of the panel sheet beneath and adjacent to and positioned radially inward or outward, respectively, from the score, the two double folds thereby forming first and second cut protection beads. Therein, the scored central bead is bent and forms an annual concave recess about the score on the outer side of the closure panel. Thus, upon pulling-open of the closure panel at the score line, the ensuing rough edges will be angled inwardly toward the two cut protection beads underneath, thereby reducing an exposure of the user to the rough edges.

U.S. Pat. No. 3,945,334 B describes another manner of double folding of a container panel on opposite sides of a weakening or score line, thereby providing protective folds which overlap the raw edge that results from the tearing-open of the panel along the weakening line.

In these known easy open ends for containers, generally the wall thickness of the lid as such remains constant throughout the lid. That is, the lid in the minimum substantially has a triple thickness at the locations of the double folds of the lid where the respective sheet portions lie one above the other. It is thus a general problem of these known easy open ends (lids) for containers that a larger amount of sheet material is needed as the material for manufacturing the double fold in the panel sheet is taken from lid preform as such. In other words, the initial unfolded blank member of the lid needs to have a larger overall diameter or extension which then is reduced by the folding process thereby obtaining the correct final diameter or extension for the panel to fit to and close the container at the concerned container end.

Considering the fact that containers having easy open ends, such as cans for food and/or drinks, are produced in very high quantities, it is a negative economical factor for the manufacturer of the container having to use a larger amount of sheet metal material for producing containers having easy open ends (lids) of the above described kind. Due to the consumption of the required sheet metal material, such lids have higher manufacturing costs which the clients of the lid manufacturers generally do not want to pay.

It is therefore an object of the invention to provide a lid or an easy open end, preferably made of steel, for a container being less expensive in its manufacture and thus economically more beneficial, while, at the same time, providing the same safety features as in the prior art containers to reduce the risk of a user's injury when opening the container.

U.S. Pat. No. 3,765,352 B describes an easy open end for a container similar to those described above, having a dull surface closely adjacent to the sharp edge to form a shield to avoid a user's injury at the sharp edge. Herein, a can end blank made of aluminum or an aluminum alloy includes a connecting wall which is coined, i.e. squeezed between two coining dies, the compressive force of which is sufficient to cause thinning and consequently axial elongation of the connecting wall. This elongation facilitates the formation of reverse bends in the can end blank in that the connecting wall is compressed lengthwise and thereby collapses.

Accordingly, some of the material of the connecting wall is used to form the reverse bends. The arrangement and the coining operation of this known can end are such that the formed reverse bends are located at one side, namely radially inwards of the score line, wherein the material of the can end blank radially inwardly of the score line is thinner than the material radially outwardly of the score line as a result of the coining operation. Consequently, this known device requires a complex arrangement of tools and dies, including the coining dies for compressing and thinning said connecting wall.

U.S. Pat. No. 9,938,043 B2 describes an end closure for food and beverage containers. The end closure comprises a score fracture force reduction feature as a collapsible form raised above the center panel and having a score line. A coined area surrounds the raised form.

Besides the above mentioned object, it is therefore a further object of present invention to provide a lid or an easy open end, preferably made of steel, for a container that can be manufactured with simpler, less complex tools and dies as compared to the devices of the prior art, thereby further contributing to a reduction of the manufacturing costs.

These objects are achieved by a method for producing a lid for a container according to embodiments.

Accordingly, the invention provides a method for making an easy open end for a container, comprising the following steps (a) providing a preform of the lid, wherein the preform of the lid has opposing first and second sides, wherein the first side faces towards the inside of the container when the lid is affixed to the container;

(b) forming a bead in the preform of the lid, wherein the bead extends out of said second side in an axial direction from said first side towards said second side, wherein the bead comprises two radially spaced apart side wall portions and a bridge portion connecting the side wall portions;

(c) thinning the side wall portions of the bead at least partially, thereby elongating the side wall portions;

(d) forming a score line in the bridge portion of the bead on said second side;

(e) flattening the bead such that the two thinned side wall portions collapse, thereby providing the lid.

It is preferred that the method steps are performed in consecutive order (step (a) to step (e)).

The thinning may be (wall) ironing.

In a preferred embodiment of the invention, the method for making an easy open end for a container provides that, when flattening the bead (above mentioned step e), the two thinned side wall portions are being bent towards each other, thereby forming two opposite projections. Preferably the two thinned side wall portions are being bent radially inwardly towards each other. These two projections may be moved towards each other substantially until they are adjacent to or abutting each other.

In a further embodiment of the manufacturing method and the easy open end for a container as such according to the invention, when the bead is flattened (above mentioned step e), the bridge portion can be moved towards the two projections underneath (which projections are formed from the collapsed, folded thin side walls of the bead) substantially until the bridge portion is positioned under a distance to or is adjacent to the projections or abuts the projections. Therein, the two projections may substantially be positioned adjacent to or abutting each other in a radial direction. This enables a final cross-sectional form of the container panel or lid in this region such that e.g. the bridge portion and the two projections together are arranged in a form substantially resembling the letters O or Ω or having a mushroom-like form, or alternatively such that e.g. the bridge portion and the two projections are lying closely above each other in the manner of a stack of the respective wall portions of the sheet material of the panel/lid.

The step of thinning the side wall portions (step c) may be performed incrementally in separate steps. It is preferred that the step of thinning the side wall portions is performed in at least three separate steps.

In each of said separate steps the side wall portions may be thinned by at most 0.08 mm, preferably by at most 0.05 mm. In each of said separate steps the side wall portions may be thinned by between 0.01 mm and 0.08 mm, preferably by between 0.03 mm and 0.06 mm.

After thinning the side wall portions (step c), the thinned side wall portions may have a thickness of at most 0.20 mm, preferably at most 0.15 mm, more preferably at most 0.11 mm. It is preferred that the thickness of the side wall portions is between 0.08 mm and 0.11 mm after thinning of the side wall portions.

When (during) flattening the bead (step e), the bridge portion may substantially maintain its original form and alignment with respect to said second side.

When (during) flattening the bead (step e), the bead may as well be bent at the score line so that the bridge portion does not maintain its original form and alignment with respect to said second side.

Both embodiments may result in a form of the bridge portion of the bead such that the bridge portion extends outwardly from said second side in a substantially outwardly rounded, convex manner, or alternatively such that the bridge portion substantially forms an inwardly rounded, concave recess about the score on the upper or outer side of the bridge portion.

Upon or after flattening the bead (step e), the bridge portion may extend outwardly from said second side in a (substantially) convex manner.

When flattening the bead (step e), the bridge portion may be moved towards the two projections (substantially) until the bridge portion is arranged under a distance to or is adjacent to or abuts the projections.

The provided preform of the lid (step a) may have a (average) thickness of between 0.12 mm and 0.25 mm, preferably between 0.16 mm and 0.23 mm. The (average) thickness of the preform may be approximately 0.16 mm, approximately 0.18 mm, approximately 0.20 mm or approximately 0.23 mm. The "approximately" may allow a deviation of ±10% or ±5%.

The bridge portion may have a wall thickness, preferably after the flattening step, of between 0.12 mm and 0.25 mm. Preferably the bridge portion has a wall thickness, preferably after the flattening step, of approximately 0.16 mm, approximately 0.18 mm, approximately 0.20 mm or approximately 0.23 mm. Again, the "approximately" may allow a deviation of ±10% or ±5%.

Upon forming the score line in the bridge portion of the bead (step d), the bridge portion may have a residual thickness of between 0.02 mm and 0.15 mm, preferably between 0.05 mm and 0.09 mm, underneath the score line (30). Preferably, the residual thickness is approximately 0.07 mm (±10% or ±5%).

According to the invention, it is preferred that the step of forming the score line in the bridge portion of the bead (above mentioned step d) is undertaken after the step of thinning the side walls of the bead (step c). This may be advantageous as the formation of the score line can then use the larger forces that result from the thinning, e.g. ironing, process as compared to other or normal forming processes.

Alternatively, it may in certain cases also be beneficial that the step of forming the score line in the bridge portion of the bead (step d) is undertaken prior to the step of thinning the bead (step c).

Furthermore, the invention provides a lid, preferably an easy open end, for a container which is made according to the above-mentioned method.

Besides, the invention provides a lid or end, preferably an easy-open-end, for a container. The lid has opposing first and second sides, wherein the first side faces towards the inside of the container when the lid is affixed to the container, and wherein the lid has a first thickness. The lid comprises a bead that is formed in the lid and the bead extends out of said second side in an axial direction from said first side towards said second side. The bead comprises two, preferably radially spaced apart, side wall portions and a bridge portion connecting the side wall portions, wherein a score line (as a mechanically weakened portion) is formed in the bridge portion of the bead on said second side. The side wall portions of the bead have at least partially a wall thickness that is smaller than the first thickness of the lid. It is preferred that the first thickness of the lid is present at a location or a portion of the lid other than the side walls. Preferably, the thickness of the lid is measured/determined at a location/portion of the lid other than the (thinned) side walls.

The side wall portions of the bead may have at least partially a wall thickness that is smaller by at least 0.050 mm, preferably by at least 0.075 mm, more preferably by at least 0.10 mm, most preferred by at least 0.125 mm, than the first thickness of the lid.

The side wall portions of the bead may be bent towards each other, thereby forming two opposite projections.

The two projections may be (substantially) arranged adjacent to or abutting each other, and the bridge portion substantially is arranged under a distance to or adjacent to the projections or abuts the projections.

In any of the herein disclosed embodiments, the (preform of the) lid/end may comprise a metal, e.g. aluminum or steel, preferably steel. The (preform of the) lid/end may substantially (at least 90% by weight or at least 95% by weight) made of aluminum or steel, preferably steel.

The first side and the second side of the (preform of the) lid/end may be coated with PET (polyethylene terephthalate), preferably each side being coated with a PET layer having a thickness between 0.010 mm and 0.030 mm, more preferably about 0.020 mm (±10% or ±5%).

Also, the first side and the second side of the (preform of the) lid/end may be coated with PVC (polyvinyl chloride), preferably each side being coated with a PVC layer having a thickness between 0.010 mm and 0.030 mm, more preferably about 0.020 mm (±10% or ±5%).

The first side and the second side of the (preform of the) lid/end may be coated with an organosol, preferably each side being coated with an organosol layer having a thickness between 0.010 mm and 0.030 mm, more preferably about 0.020 mm (±10% or ±5%).

A container may comprise any herein disclosed lid. The container may be a metal container. The container may comprise foodstuff.

Thus, according to the invention, a bead that is formed in the lid or end for a container is thinned thereby elongating the two side walls of the bead in a substantially symmetrical manner. By this thinning process, the material of the two side walls is evenly, uniformly and symmetrically distributed, thereby keeping the forces on both sides of the bead, e.g. the forces acting within the side walls, equal. A score line is then formed on the outside of the outermost or top or bridge or cover portion of the bead.

This bead is then flattened in the direction towards the plane of the lid such that the two thinned side walls fold or collapse and are being bent inwardly towards each other in a substantially symmetrical manner. Thereby, the folded side walls form two opposite shoulders or projections that are substantially located underneath the score line in the bridge portion of the bead. As described above, these shoulders or projections form a safety feature to avoid an injury of the user at the sharp edges that result from the panel or lid at the score line when the easy open end is pulled or teared along the score line to open the container.

Furthermore, with the method and device of the invention, a lesser amount of sheet material of the panel or lid is needed to form the double fold for the safety projections in the panel/lid. Accordingly, the material for manufacturing the easy open end is not taken from the overall diameter or extension of the preform of the lid/end, so that the overall diameter or extension substantially remain constant throughout the manufacture of the panel/lid. Rather, the material or the volume of the material for manufacturing the double fold in the panel/lid is taken from the thickness of the panel sheet as such in that a certain amount of material is displaced during thinning of the side wall portions of the bead.

Consequently, as these thinned side wall portions are folded, the final panel comprising the bead with the score line on top does not have a minimum thickness at the locations of the double folds of the panel sheet of substantially three times the original thickness of the panel sheet material, but has a lesser minimum thickness (e.g. at least 10% lesser or at least 20% lesser minimum thickness). E.g. twice the thickness of the respectively folded thinned side wall portion added by the thickness of the bridge portion of the bead. This minimum thickness of course applies only when the respective side wall and bridge portions of the bead are folded closely onto one another, i.e. when they lie closely one above the other without any free space in between.

Consequently, for manufacturing the container end with a safe score line according to the invention, a lesser amount of sheet metal material is required, resulting in correspondingly reduced manufacturing costs. Considering the high quantities in which such containers are generally produced, this is an important economic and financial factor for the container manufacturer.

Finally, simpler and less complex tools and dies are only required for manufacturing the container with the easy open end according to the invention, as the thinned and elongated side wall portions of the bead do not have to be manufactured by coining and squeezing or pressing, thereby avoiding respective coining dies applying certain compressive forces onto the material. Rather, the thin side wall portions of the bead may be manufactured by (wall) ironing the bead. This just requires simple tools, thereby further contributing to a reduction of the manufacturing costs.

Summarizing, the invention provides an easy open end for a container being less expensive in its manufacture due to a savings in the used material and due to little or substantially reduced requirements as regards manufacturing tools, while, at the same time, providing safety features in the form of shoulders or projections that cooperate with and/or protect the sharp edges of the opened score line of the container panel/lid thereby reducing the risk of injury for a user of the container.

Further details and advantages of the invention will become apparent from the following detailed description of embodiments of the invention with reference to the enclosed drawings.

Figure 1:
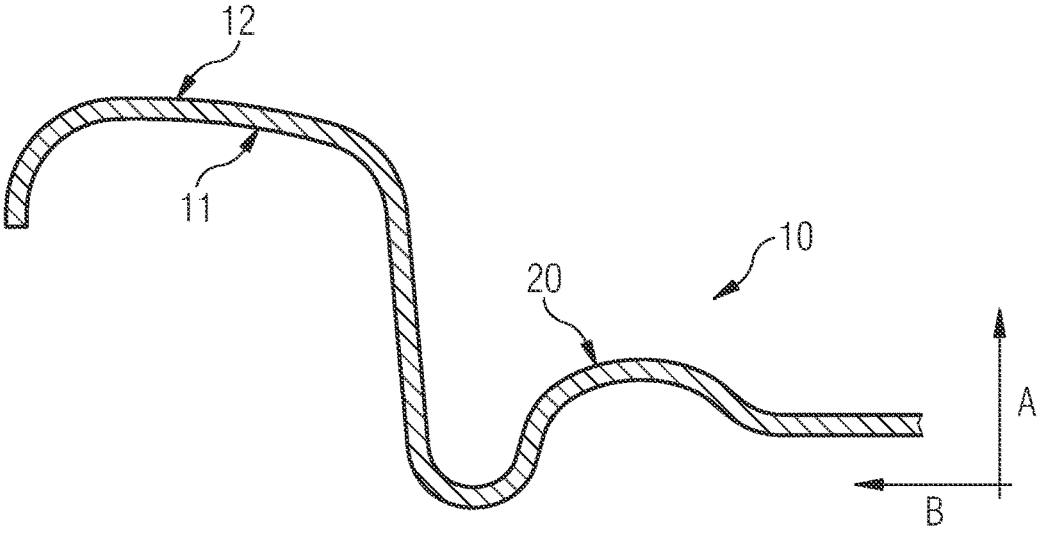
FIG. 1 is a cross-sectional partial view of a basic form of a lid preform (easy open end preform) for a container according to the invention.

FIG. 1 shows a cross-sectional view of a part of a basic form of a preform of a lid 10 which lid 10 is adapted to close a container at one side or end thereof, such as a can containing foods or drinks (not shown). Here, the preform of the lid 10 substantially already has the extension and/or diameter that is required so that the final lid 10 can be attached to and/or seamed on the container. In practice, this basic shape is also called shell.

The preform of the lid 10 has a first side 11 and an opposing second side 12, wherein the first side 11 faces towards the inside of the container when the lid 10 is affixed to the container, and wherein the second side 12 faces towards the outside of the container. FIG. 1 also shows an initial, basic form of a bead 20 in the preform of the lid 10. This bead 20 is formed and developed further in the following steps of the manufacturing process for making an easy open end for the container (lid).

For the purposes of this specification, the "axial direction" shall be the direction extending vertically from or out of the general plane of the lid 10, whereas the "radial direction" shall be the direction extending parallel to or in the general plane of the lid 10 or the preform of the lid 10. In other words, the "axial direction" extends from the first side 11 towards the second side 12 of the (preform of the) lid 10, or vice versa, when the first and second sides 11, 12 are seen lying in the general or main plane of the overall lid 10. In FIG. 1, the "axial direction" is designated by the arrow A, and the "radial direction" is designated by the arrow B. Thus, these two directions extend perpendicularly to each other. Furthermore, this definition shall also apply in cases where the (preform of the) lid 10 does not have a round or circular form, as the present invention is applicable not only to round or circular lids but also to any other possible form of a lid, e.g. an oval or oblong or substantially rectangular form.

Figure 2:
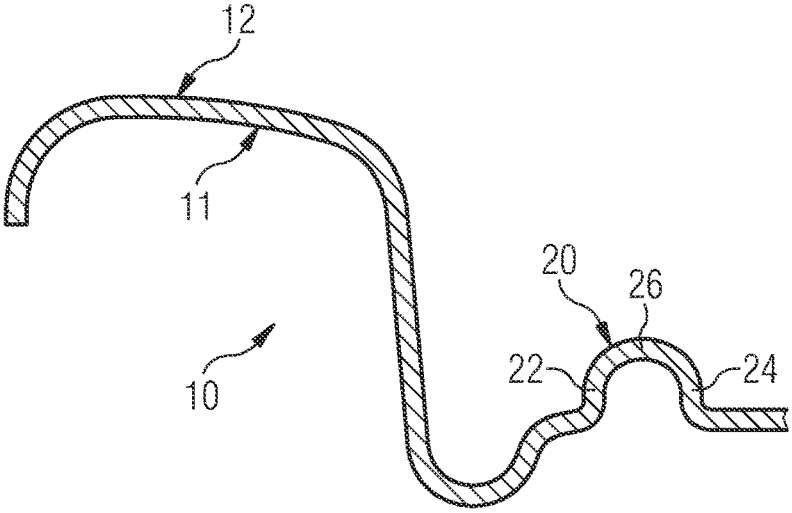
FIG. 2 is a cross-sectional partial view of a first intermediary stage in the formation of a lid for a container according to the invention.

Following the basic shape of the preform of the lid 10 as shown in FIG. 1, the material of the preform of the lid 10 is formed further in the next manufacturing steps. FIG. 2 shows a first intermediary stage in this further formation of the lid 10. As can be seen in FIG. 2, the bead 20 is formed extending already further out from the preform of the lid 10. Particularly, the bead 20 extends out of the second side 12 of the preform of the lid 10 in an axial direction with respect to the preform. This bead 20 comprises two side wall portions 22, 24 which are spaced apart from each other in a radial direction with respect to the (preform of the) lid 10. Furthermore, the bead 20 comprises an outermost or top or cover or bridge portion 26 which connects the two side wall portions 22, 24. Thus, the bead 20 substantially has a symmetrical shape in its cross-section. This form is advantageous for the following further manufacturing steps.

In the next manufacturing step, the side walls 22, 24 of the bead 20 are thinned, e.g. by ironing, thereby elongating the two side wall portions 22, 24. Accordingly, the volume of material for accomplishing the axial elongation of the side wall portions 22, 24 is taken from the lid 10 as such in that the side wall portions 22, 24 are thinned. In other words, the thickness of the lid 10 is reduced from the initial thickness in the region of the side wall portions 22, 24. The result of this step is substantially shown in FIG. 3. This thinning process of the bead can be made either continuously or incrementally in separate steps. In the latter case, in each of said separate steps the thickness of the side wall portions 22, 24 can be reduced by approximately 0.05 mm.

In a preferred embodiment, the thinned side wall portions 22, 24 have a thickness W of approximately 0.1 mm at the end of the process step of thinning the side walls 22, 24.

In contrast to the side wall portions 22, 24, the bridge portion 26 as such substantially maintains the initial thickness of the lid 10 during and after the thinning process. Thus, in a preferred case where the preform of the lid 10 originally may have a thickness of approximately 0.16 to 0.23 mm, also the bridge portion 26 substantially has a wall thickness C of approximately 0.16 to 0.23 mm, both prior to and after the thinning step of the side wall portions 22, 24 (see FIG. 3).

Figure 4:
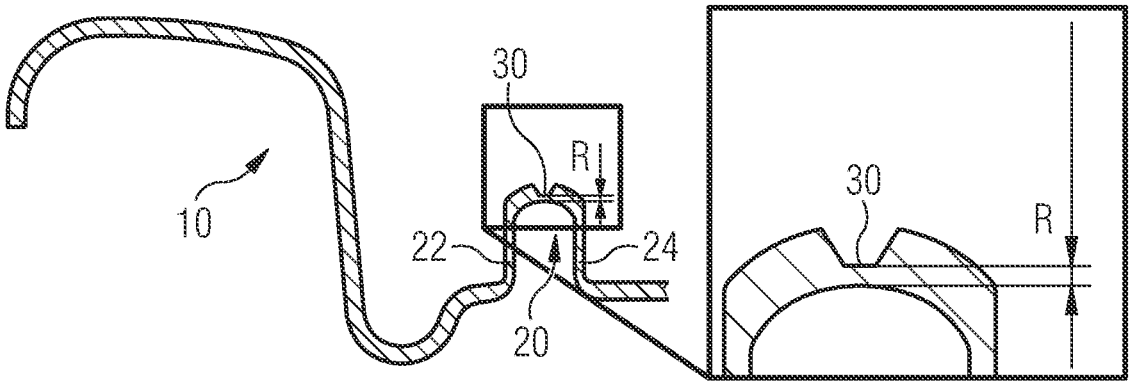
FIG. 4 is a cross-sectional partial view of a third intermediary stage in the formation of a lid for a container according to the invention.

As the next step for manufacturing the easy open end (lid) for a container, a score line 30 is formed on the outside of the bridge portion 26 of the bead 20, i.e. on the second side 12 of the preform of the lid 10 substantially on top of the bead 20. FIG. 4 shows this third intermediary stage of the manufacturing process, partly in a cut-out enlarged view. This score line 30 is a weakened line along which the final lid 10 can be pulled-open by a user via a pull-tab, as was explained above. Accordingly, the thickness C of the bridge portion 26 is reduced at the score line 30. In a preferred case, the bridge portion 26 has a residual thickness R of approximately 0.07 mm underneath the score line 30.

Figure 3:
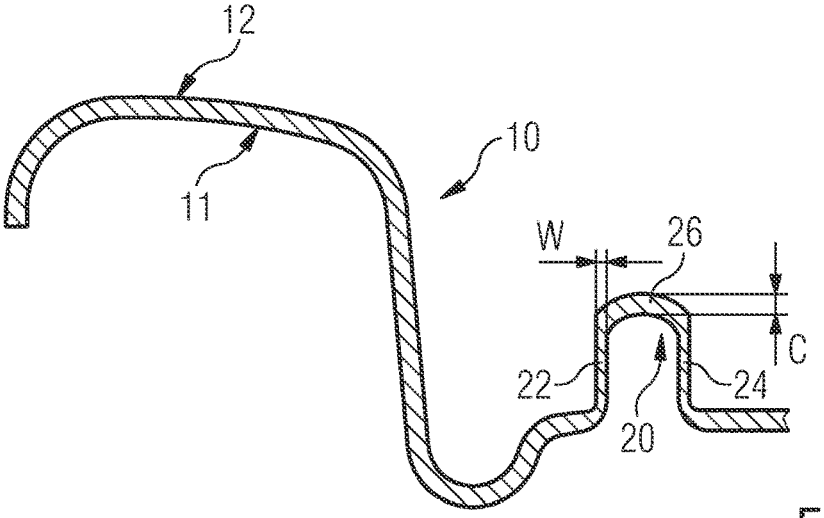
FIG. 3 is a cross-sectional partial view of a second intermediary stage in the formation of a lid for a container according to the invention.
Figure 5:
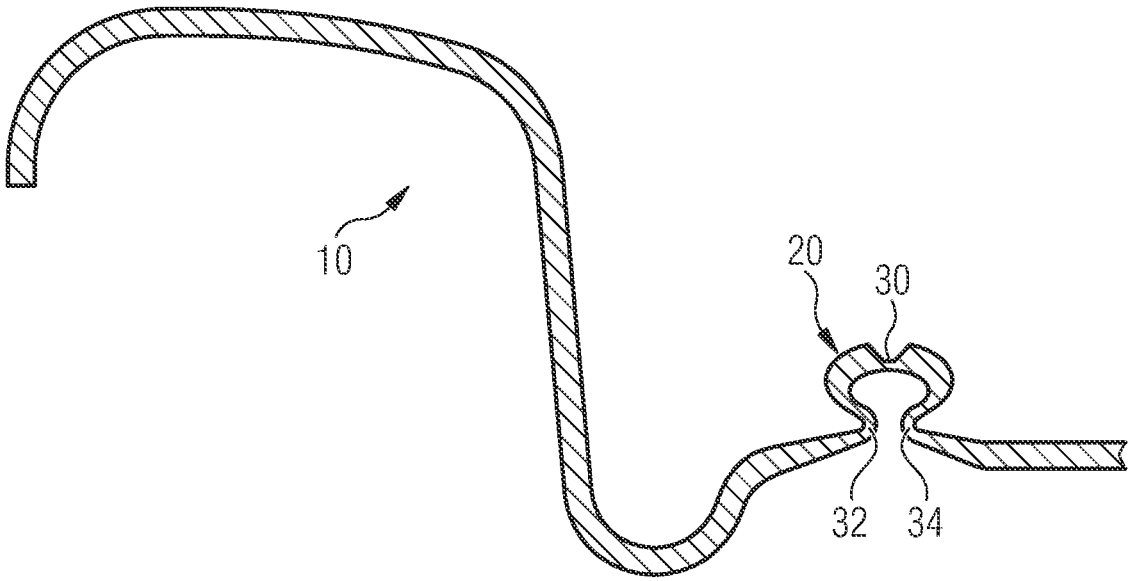
FIG. 5 is a cross-sectional partial view of a final stage in the formation of a lid for a container according to the invention.

In a substantially final manufacturing step, the result of which is shown in FIG. 5, the bead 20, which has been extended outwardly in the preceding manufacturing step, is now flattened (compressed), i.e. in the axial direction towards the second side 12 of the lid 10. Thereby, the two thinned side wall portions 22, 24 collapse, i.e. move out of their straight axial alignment (which is shown in FIGS. 3 and 4), and are being folded or bent towards each other, preferably in a substantially symmetrical manner. Thereby, two opposite projections or shoulders 32, 34 are formed that move towards each other during the compression of the bead 20. At the end of the manufacturing step of flattening the bead 20, said projections or shoulders 32, 34 can be positioned adjacent to each other, leaving a free space between them, or can even abut each other.

After this step a lid 10, e.g. an easy open end, is formed. Further steps can be performed after the above described substantially final manufacturing step. E.g. a pull-tab may be attached to the lid 10, preferably via a rivet.

During the compression of the bead 20, the bridge portion 26 of the bead 20 is moved downwards and towards the two simultaneously formed projections 32, 34, substantially either until the bridge portion 26 remains arranged under a distance to the projections 32, 34 or until the bridge portion 26 is substantially lying on and abutting the projections 32, 34. This results in the double-folded arrangement of the lid 10 in the region of the bead 20 and the score line 30, as it was explained in the introduction above. In the first of said latter two cases, which substantially is shown in FIG. 5, the compressed bead 20, i.e. the bridge portion 26 together with the folded side walls 22, 24 which form the projections 32, 34, has a cross-sectional form substantially resembling the letters O or Ω or having a substantially mushroom-like form. In the second of the above mentioned two cases, the bead 20 is substantially flattened fully to a maximum so that the lower side of the bridge portion 26 lies closely on the completely folded side walls 22, 24 or projections 32, 34, respectively, substantially leaving no or only very little free space between the stacked individual layers of the folded lid 10 formed by the bridge portion 26 and the projections 32, 34 underneath.

Furthermore, during the flattening of the bead 20 in the axial direction towards the outer or second side 12 of the lid 10, the bridge portion 26 can substantially maintain its original form and alignment or orientation with respect to said second side 12. In other words, while the side walls 22, 24 are deformed in that they collapse and are folded to form the projections 32, 34, the bridge portion 26 as such is substantially not deformed but is moved as such in the downwards direction.

Alternatively, during the flattening of the bead 20, the bead 20 and particularly the bridge portion 26 can be bent at the score line 30 whereby the bridge portion 26 does not maintain its original form and alignment or orientation with respect to the second side 12 of the lid 10. In this case, the bridge portion 26 can e.g. be deformed such that in the end it is rounded outwardly, i.e. extends outwardly from the second side 12 in a substantially convex manner. This form resembles the general form of the bridge portion 26 as it is shown in FIG. 5. In an alternative case, the bridge portion 26 as such can e.g. be deformed such that in the end it is depressed inwardly, i.e. forms a concave recess about the score line 30.

Figure 6:
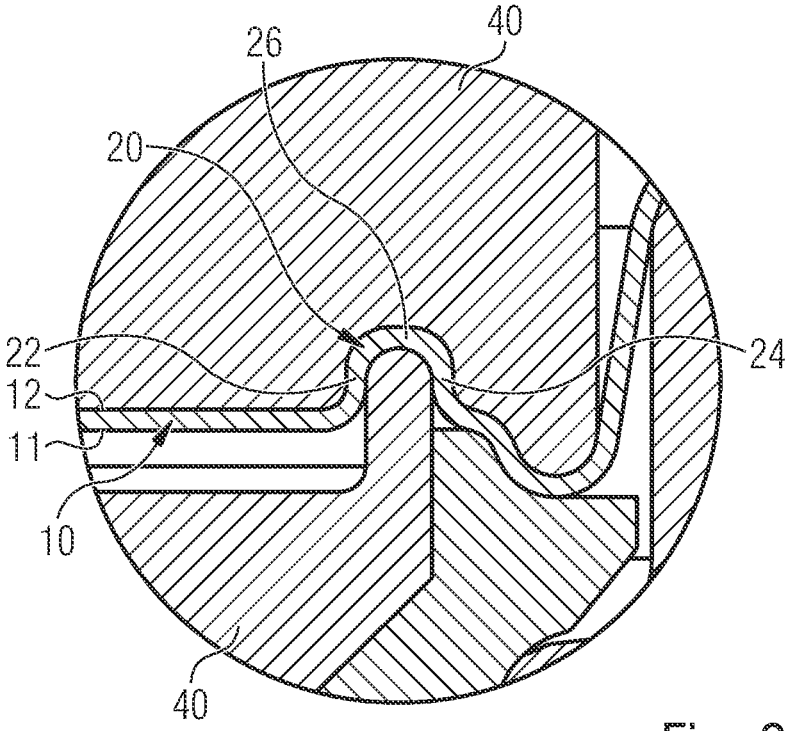
FIG. 6 is a cross-sectional partial view of the first intermediary stage in the formation of a lid similar to FIG. 2, now including tools.
Figure 7:
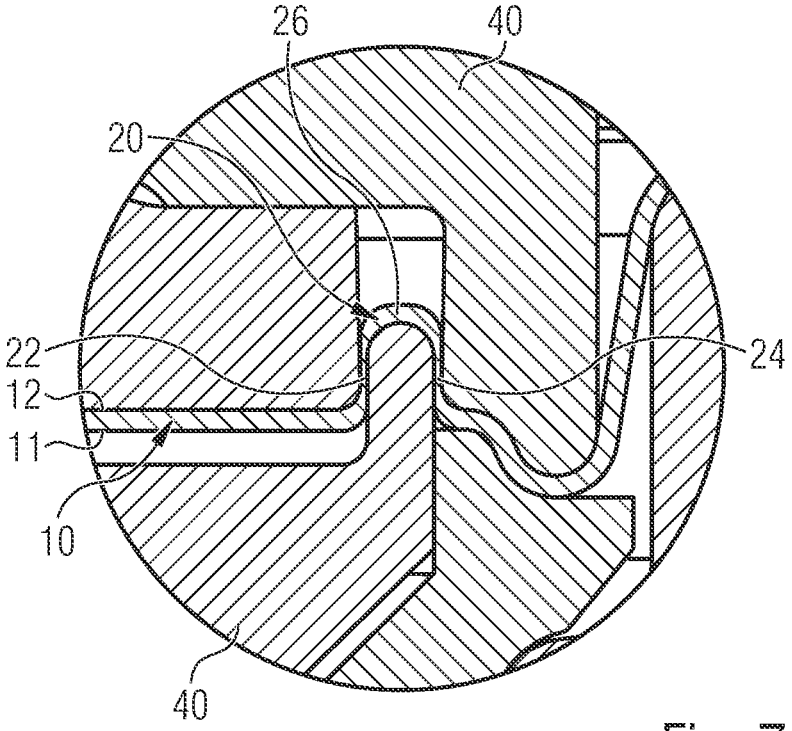
FIG. 7 is a cross-sectional partial view of the second intermediary stage in the formation of a lid similar to FIG. 3, now including tools.

FIG. 6 is a cross-sectional partial view of the first intermediary stage in the formation of the closure lid 10 (easy open end) similar to FIG. 2, however now additionally showing the forming tools and/or dies 40 surrounding and working on the lid 10. Similarly, FIG. 7 is a cross-sectional partial view of the second intermediary stage in the formation of the lid 10 similar to FIG. 3, again now including the forming tools and/or dies 40. Accordingly, in FIG. 6, the bead 20 is initially formed in its basic shape by drawing the bead 20 axially out of the lid 10 in the outwards direction with respect to the container, i.e. in the direction out of the second, outer side 12 of the lid 10.

In FIG. 7, the side wall portions 22, 24 of the formed bead 20 are thinned (e.g. by ironing), thereby the side wall portions 22, 24 are elongated. As can be seen in FIG. 7, after this process step, the thickness of the side wall portions 22, 24 is smaller than the general thickness of the lid 10 at both radial sides of the bead 20, whereas the bridge portion 26 maintains the general thickness of the (preform of the) lid 10.

The invention claimed is:

1. A method for producing a lid for a container, the lid being adapted for closing the container, comprising:

providing a preform of the lid (10), wherein the preform of the lid (10) has opposing first and second sides (11, 12), wherein the first side (11) faces towards an inside of the container when the lid (10) is affixed to the container;

forming a score line bead (20) in the preform of the lid (10), wherein the score line bead (20) extends out of said second side (12) in an axial direction from said first side (11) towards said second side (12), the score line bead (20) comprising two radially spaced apart side wall portions (22, 24) and a bridge portion (26) connecting the side wall portions (22, 24) and forming a score line (30) in the bridge portion (26) of the score line bead (20) on said second side (12);

at least partially thinning the two radially spaced apart side wall portions (22, 24) of the score line bead (20) resulting in elongated side wall portions (22, 24) of the score line bead;

and flattening the score line bead (20) such that the two thinned side wall portions (22, 24) collapse;

wherein flattening the bead (20) causes the two radially spaced apart thinned side wall portions (22, 24) to bend towards each other and form two opposite projections (32, 34), and the bridge portion (26) substantially maintains its original form and alignment with respect to said second side (12) after the score line bead (20) is flattened.

2. The method according to claim 1, wherein the two projections (32, 34) are moved towards each other substantially until they are adjacent to or abutting each other.

3. The method according to claim 1, wherein the step of thinning the two radially spaced apart side wall portions (22, 24) is performed incrementally in a plurality of separate steps.

4. The method according to claim 3, wherein the two radially spaced apart side wall portions (22, 24) are thinned by between 0.01 mm and 0.08 mm.

5. The method according to claim 1, wherein the two thinned radially spaced apart side wall portions (22, 24) have a thickness (W) of at most 0.20 mm after thinning.

6. The method according to claim 1, wherein flattening the score line bead (20) causes the score line bead (20) to bend at the score line (30) so that the bridge portion (26) does not maintain its original form and alignment with respect to said second side (12).

7. The method according to claim 1, wherein the bridge portion (26) extends outwardly from said second side (12) in a substantially convex manner after the score line bead (20) is flattened.

8. The method according to claim 1, wherein flattening the score line bead (20) causes the bridge portion (26) to move towards the two projections (32, 34) substantially until the bridge portion (26) is arranged under a distance to or is adjacent to or abuts the projections (32, 34).

9. The method according to claim 1, wherein the preform of the lid (10) has a thickness of between 0.12 mm and 0.25 mm.

10. The method according to claim 1, wherein after flattening the bead, the bridge portion (26) has a wall thickness (R) of between 0.12 mm and 0.25 mm.

11. The method according to claim 1, wherein, upon forming the score line (30) in the bridge portion (26) of the bead (20), the bridge portion (26) has a residual thickness (R) of between 0.05 mm and 0.09 mm underneath the score line (30).

12. The method according to claim 3, wherein in each of said plurality of separate steps the side wall portions (22, 24) are thinned by between 0.03 mm and 0.06 mm.

13. The method according to claim 1, wherein each of the thinned side wall portions (22, 24) have a thickness (W) of between 0.08 mm and 0.11 mm after thinning.

14. The method according to claim 1, wherein the preform of the lid (10) has a thickness of between 0.16 mm and 0.23 mm.

15. The method according to claim 1, wherein the bridge portion (26) has a residual thickness (R) of approximately 0.07 mm, underneath the score line (30) after forming the score line (30) in the bridge portion (26) of the bead (20).

* * * * *